United States Patent [19]

Blass

[11] 3,950,757

[45] Apr. 13, 1976

[54] BROADBAND WHIP ANTENNAS

[75] Inventor: Judd Blass, Herzliah Petuach, Israel

[73] Assignee: Beam Systems Israel Ltd., Nof Yam, Israel

[22] Filed: Mar. 12, 1975

[21] Appl. No.: 557,836

[52] U.S. Cl. ..... 343/791; 343/850; 343/900

[51] Int. Cl.[2] ..... H01Q 9/30

[58] Field of Search ..... 343/715, 749, 750, 791, 343/792, 850, 900

[56] References Cited

UNITED STATES PATENTS

| | | | |
|---|---|---|---|
| 2,454,774 | 11/1948 | Chesus et al. | 343/791 |
| 3,208,069 | 9/1965 | Brueckmann | 343/850 |

*Primary Examiner*—Eli Lieberman

*Attorney, Agent, or Firm*—Ostrolenk, Faber, Gerb & Soffen

[57] ABSTRACT

A whip antenna with a substantially constant impedance over a broad band of radio frequencies includes a mounting section, a high-power-dissipation low-resistance assembly, a first whip section, a second whip section, and a high-impedance quarter-wavelength transformer section concentrically formed around the first whip section and extending from the resistance assembly to the junction of the first and second whip sections. The low-resistance termination is attached close to the base of the antenna and is transformed to a high resistance at the junction of the first and second whip sections at the frequency where the matching section length equals one quarter-wavelength. The resistive power loss only occurs over a limited band centered at the design frequency of the matching section. Instability caused by emplacement of a high-mass resistive termination towards the top of the complete antenna is thus avoided.

7 Claims, 5 Drawing Figures

BROADBAND WHIP ANTENNAS

BACKGROUND OF THE INVENTION

The present invention relates to antennas and more particularly to a novel whip antenna configuration providing uniform electrical performance over a broad band of frequencies.

Vehicles equipped for radio communications require specialized antenna installations. The antenna height is restricted by obstacles, such as highway overpasses and tunnels, under which the vehicle must travel without damaging the antenna. The antenna must exhibit a large degree of resiliency to avoid wind-load distortion or breakage when the vehicle is in motion and yet return as quickly as possible to a vertical direction for minimum radiation polarization loss when the wind-load diminishes. The antenna must possess a uniform circular radiation pattern in the horizontal plane so that radio communications can be established without regard to the vehicle's direction of travel.

One antenna type which exhibits these characteristics is the whip antenna, which is characterized by a long, thin conductive cylindrical member attached to an insulated mounting base. The radio communications equipment is electrically connected by a cable to the base end of the whip. The electrical length of the basic whip is usually chosen to be less than a full wavelength. In an antenna one-half wavelength long, for example, the antenna impedance approaches the impedance of commonly used coaxial cables and an acceptable VSWR is obtained. Most of the transmitter output power is dissipated by the antenna and is not reflected back to the transmitter. The antenna impedance is extremely frequency sensitive due to the shifting of the minimae of the standing wave of current along a fixed length antenna. As the operating frequency varies over the frequency range of operation, the impedance changes and the antenna and cable impedance are no longer closely matched. The VSWR and the amount of reflected power both increase causing a decrease in the amount of radiated power and antenna efficiency. Because the whip antenna is only efficient over a small range of frequencies, it is not uncommon for vehicles with multiple frequency transmission capability to require several different length antennas. A whip antenna having a constant impedance over a broad band of radio frequencies is desirable.

STATE OF THE ART

It is known to provide a broadband whip antenna by inserting a large value of series resistance in the whip at a point one quarter-wavelength from the tip of the antenna. A travelling wave of current is produced in all but the top quarter-wavelength section of the antenna, which has a standing wave. The travelling wave of antenna current is characterized as being of generally constant amplitude along its entire length. The absence of antenna current maxima and minima result in a constant antenna impedance over a broader band of radio frequencies than is obtainable with the basic whip antenna. This antenna has been described in detail in the article by E. E. Altshuler, entitled "The Travelling-Wave Linear Antenna," IRE Transactions On Antennas and Propagation, Vol. AP-9, July, 1961.

This antenna is impractical for vehicular use. A practical length-to-diameter ratio of a whip antenna is of the order of 200:1. The emplacement of a high-mass resistive assembly toward the tip of such a thin whip will cause undesirable instability of the antenna and fluctuations in the magnitude of antenna radiation when the vehicle is in motion. A second undesirable feature is that the resistive assembly will dissipate power over the entire band of frequencies employed, rather than only those frequencies at which resistance loading is necessary to adjust the frequency response of the antenna. As the resistance dissipates approximately one-half of the transmitter output power, the antenna is never more than 50% efficient over the entire frequency band of interest.

BRIEF SUMMARY OF THE INVENTION

In the present invention, a whip antenna presents a generally constant impedance across a broad operating frequency range while maintaining reasonable efficiency and minimum mass in the region of the antenna tip. The antenna impedance is made generally constant by the frequency selective insertion of a resistive component in series with the antenna at a point one-quarter wavelength below the tip of the antenna. The resistive component is effectively removed from the antenna for other portions of the frequency range. The mass of the resistive assembly is positioned in proximity with the base of the antenna to prevent mechanical instability.

The broadband whip antenna in accordance with the invention is comprised of a first quarter-wavelength whip section; a second quarter-wavelength whip section axially attached to a first end of the first whip section; a high-impedance quarter-wavelength matching section extending from the junction of the first and second whip sections toward a second end of the first whip section; a high-power low-resistance assembly electrically parallel coupled across the free end of the matching section and the second end of the first whip section; and conductive means for mounting the free end of the matching section a spaced distance from an antenna mounting base. The design frequency of the whip sections and the high-impedance transformer section is generally chosen to be in the upper 25% of a desired octave band. At this frequency the quarter-wavelength matching section transforms the low value of resistance inserted in series with the whip and in proximity to the base to the desired high value of resistance for series insertion at the junction one quarter-wavelength away from the resistance assembly. The resistance is thus tuned to the frequency necessary to properly load the whip to achieve a generally constant impedance. The broadband whip antenna presents a relatively high impedance compared to the impedance of commonly used coaxial cables. A broadband ferrite transformer in the mounting base is connected between the base end of the whip and the coaxial cable to transform the high antenna impedance to the impedance of the coaxial cable.

The broadband whip antenna just described has the advantage that it presents a generally constant impedance to radio communications equipment with which it is employed and maintains a high degree of mechanical stability while achieving good radiation efficiency over a broad band of frequencies.

Accordingly, it is the primary object of the present invention to provide a novel whip antenna of broad frequency bandwidth.

It is another object of the present invention to provide a novel whip antenna with broad frequency bandwidth obtained by frequency sensitive resistance loading.

It is a further object of the invention to provide a novel whip antenna which utilizes such frequency selective resistance loading while maintaining high mechanical stability.

These and other objects of the invention will become apparent from the following description of the accompanying drawings.

DETAILED DESCRIPTION OF THE INVENTION

Figure 1:
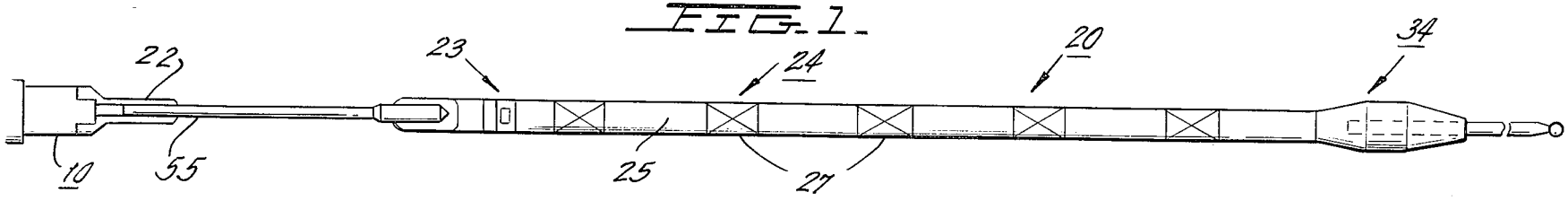
FIG. 1 is a cross-sectional view in side elevation of a broadband whip antenna in accordance with the invention.
Figure 3:
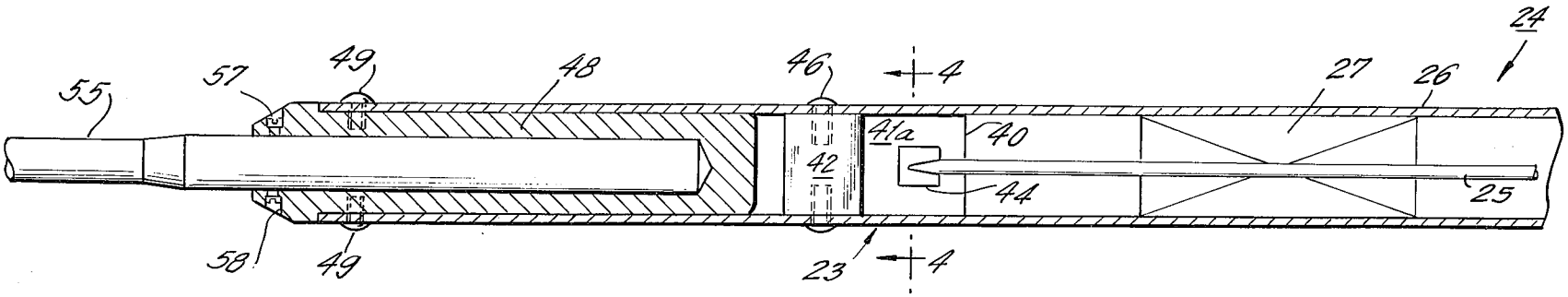
FIG. 3 is a cross-sectional view in side elevation of the high-power resistance assembly and high-impedance quarter-wavelength transformer section of the broadband whip antenna in accordance with the invention.
Figure 2:
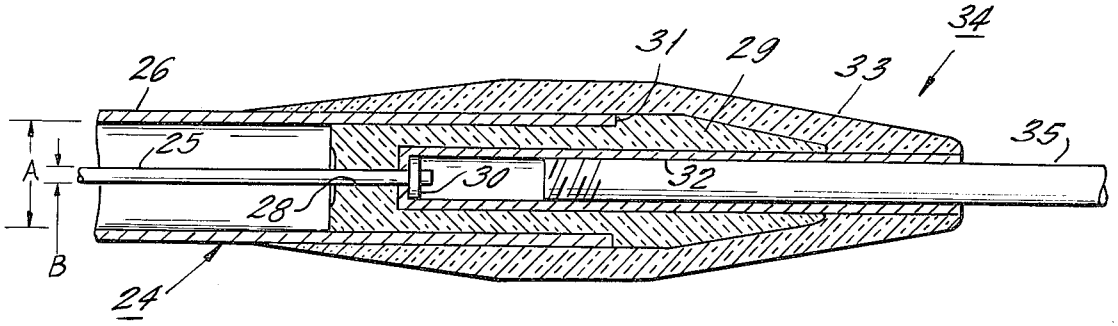
FIG. 2 is a cross-sectional view in side elevation of the structure of the junction between the two whip sections of the broadband whip antenna in accordance with the invention.
Figure 4:
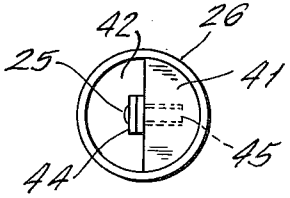
FIG. 4 is a cross-sectional view of the high-power resistive assembly of the broadband whip antenna in accordance with the invention, along the line and in the direction of arrows 4—4 in FIG. 3.
Figure 5:
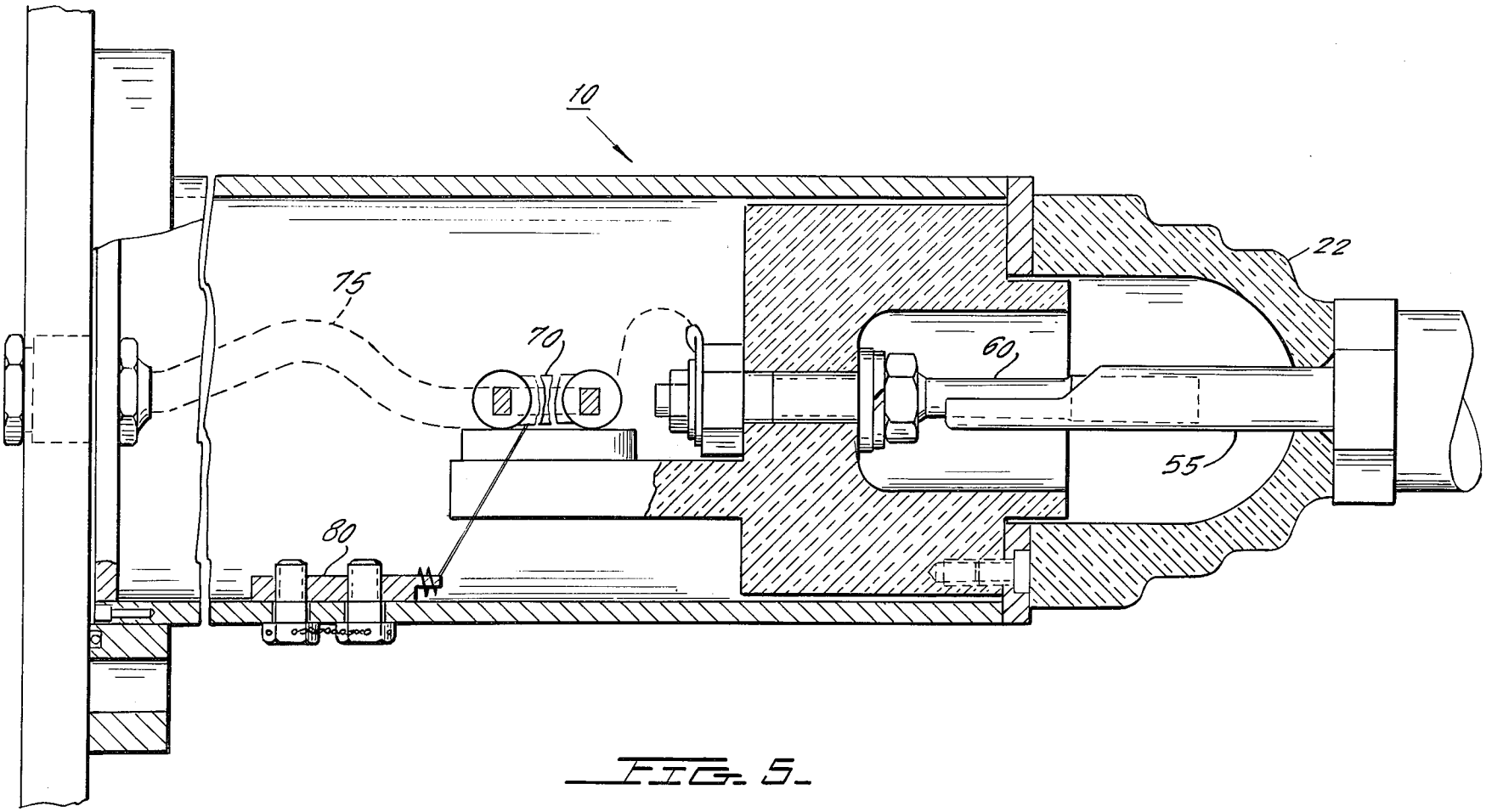
FIG. 5 is a partially-sectional view in side elevation of the mounting base of the broadband whip antenna and of the whip antenna mount with which it is used.

Referring to FIG. 1 of the drawings, a conventional mounting base 10 has been located with its axis in a generally vertical direction to receive a broadband whip antenna 20 which is attached to the mounting base 10 by a mounting section 22.

The broadband whip antenna 20 provides a generally constant input impedance across an octave band of radio frequencies. The octave bandwidth is achieved by the frequency selective insertion of a series resistance at a point one quarter-wavelength below the tip of the antenna for a design frequency experimentally derived for each frequency band and antenna length-to-diameter ratio. This design frequency is generally in the upper 25% of the octave band. The resistance assembly 23 is located close to the base of the antenna to eliminate the problem of mechanical instability caused by a high mass concentration near the antenna tip. A coaxial quarter-wavelength matching transformer 24 is formed at the design frequency by the coaxially arranged first whip section 25 and sleeve 26.

In a preferred embodiment, the broadband whip antenna is designed to be one-half of a wavelength long at the center frequency of the octave bandwidth.

Referring to all the drawings, the cylindrical matching section sleeve 26 of conducting material is at least one quarter-wavelength long at the design frequency. The first whip section 25 of conducting material is one quarter-wavelength long and is held in coaxial alignment within the bore of sleeve 26 by a plurality of dielectric supports 27. The ratio of the inner diameter A of sleeve 26 to the outer diameter B of first whip section 25 is determined by known formulae to produce a coaxial line of an impedance whose value will be described hereinafter in greater detail. One end of the first whip section 25 is introduced through an axially aligned aperture 28 in the closed end of a generally cylindrical support section 29 and is held in position by fastening means 30. The exterior surface of support section 29 is closely fitted within the bore of the matching section sleeve 26 to form an end support and contains an annular shoulder 31 to limit the amount of entry of support section 29 into the bore of the sleeve 26. A tapped conductive tube 32 is inserted within the bore of support section 29 and is fastened in firm electrical contact with the end of the first whip section 25. An insulated casing 33 is secured over the tube 32, the support section 29 and a portion of the exterior surface of the sleeve 26 in flush alignment with the open end of tube 32 to prevent the ingress of moisture and contaminants into the junction assembly 34 and the interior of the matching transformer 24. A second whip section 35 of conducting material is one quarter-wavelength long at the design frequency and is threaded for a short length inward from one end. The second whip section 35 is threadably engaged within tube 32 to form a firm electrical connection therewith.

The high-power low-resistance assembly 23 consists of a cylindrical resistive support plug 40 of conductive material having an outer diameter A approximately equal to the interior diameter of sleeve 26. A first portion 41 of generally semicircular cross section is formed at the end of resistance support plug 40 closest to junction assembly 34, while the remaining portion 42 retains the circular cross section. A thick film resistor 44 is mounted on a threaded stud 45 for insertion into a suitably tapped recess transversely entered into semicircular plug portion 41 at a point substantially centrally located on the flat diametric face 41*a* thereof. A high-conductivity electrical connection is formed between the free end of first whip section 25 and the top surface of thick film resistor 44, at a distance equal to a quarter-wavelength from butt joint 31 at the design frequency. Cylindrical plug 40 is closely received within the bore of sleeve 26 and is held in firm electrical contact therewith by set screws 46 which pass through cooperating apertures therein. Thus, resistance 44 is effectively electrically connected between the free end of first whip section 25 and sleeve section 26 at a quarter-wavelength distance from the junction between first whip section 25 and second whip section 35. The relatively massive plug acts as both an extremely low inductance connection between sleeve 26 and resistor 44 and a heat sink for the resistor to increase the transfer of dissipated energy to the metallic sleeve 26 and thence into the surrounding atmospheric medium. In a preferred embodiment, a 50 ohm thick-film stud-mounted resistor having a 2 millimeters thick resistance film measuring five millimeters square has been found to have a power dissipation rating of 20 watts when so mounted. A conductive stub support 48 generally of cylindrical shape and having one closed end is inserted into and closely received by the open end of the sleeve 26 to form a firm electrical contact therewith. Fastening means 49 pass through apertures in sleeve 46 and are threadably engaged in tapped apertures in the exterior surface of stub support 48. Cylindrical stub section 55 has one end formed to be closely received by the bore of stub support 48 and held in firm electrical contact therewith by set screws 57 which pass through apertures 58 in support 48. The other end of stub section 55 is formed to firmly engage the electrical contact 60 in mounting base 10. Insulated mounting section 22 is concentrically formed about the base end of stub section 55 to provide means for fastening the broadband whip antenna to the mounting base 10 with which it is used. Contact 60 is connected to one side of a broadband ferrite transformer 70 whose other side is connected to the center conductor of the coaxial cable 75 to the radio communications equipment. The coaxial cable shield is connected to the common lead of transformer 79 which is in turn connected to antenna system ground lug 80.

It has been experimentally determined that a whip antenna with a length-to-diameter ratio of 200:1 requires approximately 450 ohms of resistance inserted in series at the junction of the two whip sections to form a travelling wave of antenna current. The resonant coaxial transformer 24 inserts this series resistance at the frequency necessary to achieve the generally constant antenna impedance. At those frequencies where the series resistor is not required, the off-resonant reactance of the transformer effectively shunts the resistance to minimize transmitter power attenuation and to provide additional impedance linearization characteristics.

In a preferred embodiment, the whip antenna has a length substantially equal to one half wavelength at the center frequency. The length of sleeve section 26 and second whip section 35 are approximately equal and are each designed to be approximately 40% of the total antenna length. The length of cylindrical stub section 55, including any resilience-aiding portion formed thereon by a spring member or the like (not shown), is designed to be approximately 20% of the total whip antenna length. Thus, if the total whip antenna length is selected to be 250 centimeters, sleeve section 26 and second whip section 35 are approximately 100 centimeters long while cylindrical support stub 55 is approximately 50 centimeters long.

If the effective resistance between the free end of first whip section 25 and sleeve 26 is set equal to 50 ohms than the impedance of the quarter-wavelength matching section must, by known equations, be equal to 150 ohms. The ratio of the inner diameter of sleeve 26 to the outer diameter of the whip section 25 is set equal to the known formula ratio which will yield this line impedance. The resistance 44 between the center conductor 25 and the outer conductor 26 appears in series with the antenna at the junction between the first and second whip sections 25 and 35 at the design frequency of the transformer. At this frequency a travelling wave of current appears along the length of the antenna up to the junction 34. A standing wave of current is formed beyond the junction with amplitude decreasing to zero at the antenna tip. Approximately one half of the power entering the antenna at the design frequency is dissipated in this series resistance. As the antenna driving frequency increases from the design frequency to the top of the octave band, a frequency change of approximately 15% occurs. The matching transformer section 24 is no longer at its design frequency and the series resistance is electrically paralleled by a capacitive reactance at the junction between the two whip sections. This reactance tends to both shunt the resistance, so that a smaller percentage of antenna power is dissipated therein, and to shorten the antenna and provide additional impedance linearizing properties above the transformer design frequency. As the antenna driving frequency decreases from the design frequency towards the bottom of the octave band, the series resistance is electrically paralleled by an inductive reactance at the junction between the two whip sections. This inductance also tends to shunt the resistance, decreasing the amount of antenna power dissipated therein, and to lengthen the antenna and provide additional impedance linearizing properties in the lower portion of the band. The essentially constant antenna input impedance over the octave band width is matched to coaxial cable 75 by broadband ferrite transformer 70, preferably having a 2:1 turns ratio and an R.F. power rating in excess of twice the power dissipation rating of thick film resistor 44 over at least the same octave frequency band. The reactance of the untuned transformer is preferably selected both to improve antenna current distribution in the mid-band region for higher gain and to reduce coupling to base 10 or the ground plane upon which base 10 is mounted.

There has just been described a novel whip antenna for use across an octave band width of radio frequencies, wherein a linearizing resistance is positioned near the base of the antenna to increase mechanical stability while appearing as a high value of series resistance at a point one quarter-wave-length below the antenna tip due to the impedance transformation characteristics of a quarter-wavelength matching transformer. A generally constant impedance is obtained over the entire band width.

The present invention has been described in connection with a prefered embodiment thereof; many variations and modifications will now become apparent to those skilled in the art. It is preferred, therefore, that the present invention not be limited by the specific disclosure herein, but only by the appended claims.

What is claimed is:

1. A broadband whip antenna having a generally constant impedance across an octave band of radio frequencies and attachable to an insulated antenna mounting base having an antenna connection terminal therein, comprising:

a first whip section having a cylindrical conductor of a length equal to one quarter-wavelength at a particular frequency generally in the top quarter of said octave frequency band;

a second whip section having a cylindrical conductor of length equal to one quarter-wavelength at said particular frequency and having one end thereof axially attached to an end of said first whip section;

load resistance means having a first resistance value and having one terminal attached to the free end of said first whip section;

means coupled to the remaining terminal of said load resistance means and cooperating with said first whip section to transform said resistance means to a higher resistance value appearing in series connection at the junction between said first and second whip sections; and means for mounting said load resistance means a spaced distance from said mounting base with said antenna connection terminal electrically coupled to said remaining terminal of said resistance means.

2. A broadband whip antenna as set forth in claim 1, which further comprises means for increasing the dissipation of heat from said load resistance means into the surrounding atmosphere.

3. A broadband whip antenna as set forth in claim 1, wherein the electrical transforming means is frequency selective and causes reactance to be in parallel connection across said desired resistance at frequencies removed from the design frequency, whereby the amount of power dissipated by said desired resistance is decreased at frequencies removed from the design frequency.

4. A broadband whip antenna as set forth in claim 3, in which the frequency selective electrical transforming means comprises a quarter-wavelength coaxial section of characteristic impedance equal to the geometric means between said first and said higher resistance values.

5. A broadband whip antenna as set forth in claim 4, in which the coaxial section is formed by a conductive sleeve surrounding and concentric with said first whip section and insulated therefrom and extending substantially the length of said first whip section, said sleeve and first whip section forming a quarter wavelength section of a predetermined characteristic coaxial line impedance.

6. A broadband whip antenna as set forth in claim 5, in which the coaxial transformer further comprises:

a plurality of dielectric spacers extending between the exterior surface of said first whip section and the interior surface of said transformer sleeve and arrayed at spaced intervals along the length of said first whip section; and an insulated section formed about the free end of said transformer sleeve and the junction of said first and second whip sections, whereby the desired spacing between the free end of said transformer sleeve and said first and second whip sections is maintained constant and sealed from the introduction of moisture and atmospheric contaminants.

7. A broadband whip antenna as set forth in claim 1, further comprising a broadband impedance transformer means coupled to said antenna connection terminal for matching the impedance of a coaxial cable to the generally constant impedance of the broadband whip antenna across the entire antenna band width.

* * * * *